US006848605B2

(12) United States Patent
Dillenberger

(10) Patent No.: US 6,848,605 B2
(45) Date of Patent: Feb. 1, 2005

(54) TOOL BELT WITH SPACED RECEIVER BLOCKS SELECTIVELY RECEIVING BOTH COMPLIMENTARY TOOL HOLDERS AND TOOLS

(76) Inventor: Eric Dillenberger, P.O. Box 26, 400 Beecher Rd., Wolf Creek, OR (US) 97497

( * ) Notice: Subject to any disclaimer, the term of this patent is extended or adjusted under 35 U.S.C. 154(b) by 0 days.

(21) Appl. No.: 10/267,948

(22) Filed: Oct. 7, 2002

(65) Prior Publication Data

US 2004/0065709 A1 Apr. 8, 2004

(51) Int. Cl.[7] ..... A45C 1/04

(52) U.S. Cl. ..... 224/670; 224/682; 224/242; 224/271; 224/904

(58) Field of Search ..... 224/195, 197, 224/660, 663, 666, 667, 668, 669, 670, 682, 242, 271, 272, 904

(56) References Cited

U.S. PATENT DOCUMENTS 252,448 A * 1/1882 Flatau ..... 224/271
4,524,938 A * 6/1985 Strahs et al. ..... 248/110
5,035,389 A * 7/1991 Wang ..... 248/224.51
5,054,170 A * 10/1991 Otrusina ..... 24/580.11
5,604,958 A * 2/1997 Anscher ..... 24/3.1
5,729,869 A * 3/1998 Anscher ..... 24/3.1
5,957,421 A * 9/1999 Barbour ..... 248/220.21
6,098,941 A * 8/2000 Gates et al. ..... 248/224.51
6,176,403 B1 * 1/2001 Svare et al. ..... 224/251
6,290,112 B1 * 9/2001 Iver ..... 224/271
2002/0096545 A1 * 7/2002 Chang ..... 224/271

* cited by examiner

*Primary Examiner*—Stephen K. Cronin
(74) *Attorney, Agent, or Firm*—Fuess & Davidenas

(57) ABSTRACT

A tool belt mounts receiver blocks, preferably of at least two types, permanently along its length. Each receiver block releasibly receives and engages an attaching block of complimentary configuration, the two blocks serving as a two-portion connector. Each attaching block serves to attach, or is integral with, (i) one of any number of tool holders of diverse configurations, each of which tool holders serves to support an associated tool, and/or (ii) a tool itself. The belt is preferably made from web fabric, the receiver blocks and attaching blocks from strong molded plastic, and the tool holders from leather, steel and like materials contoured and adapted to engage and hold portable tools including hand tools.

8 Claims, 4 Drawing Sheets

TOOL BELT WITH SPACED RECEIVER BLOCKS SELECTIVELY RECEIVING BOTH COMPLIMENTARY TOOL HOLDERS AND TOOLS

BACKGROUND OF THE INVENTION

1. Field of the Invention

The present invention generally concerns tool belts and portable tool holders for releasibly holding portable tools.

The present invention particularly concerns tool belts and portable tool holders where portable tools of diverse types may be selectively securely attached both (i) indirectly where the tool attaches to a tool holder upon the tool belt, and (ii) directly, where the tool itself attaches to the tool belt.

2. Description of the Prior Art 2.1 The General State of the Prior Art

No two workmen are likely to use exactly the same set of transportable hand-held tools, and sometimes even the same workman will use different sets of tools having different members at different times. Accordingly, tool belts and tool holders have long accorded the potential to mount various tools.

The classic solutions to the problem of detachably mounting, and mounting at various times, various portable hand and power tools to the same tool belt have involved any of (1) hooks, and (2) snaps, on either the tool belt or the tool, and (3) pouches on the tool belt. The (3) pouches are quite often slidable in position along the tool belt, and the (1) hooks (or hooking points), and (2) snaps, may also be affixed to loops that, in encircling the belt, may be selectively positioned along its length, although often with some instability.

There are several problems with these previous approaches. Versatility in any of the (1) numbers, (2) types, (3) order, and/or (4) positions at which tools are mounted tends to induce complexity into the tool belt and the tool holding, requiring many different parts of some weight and cost. Some types of releasible mounts, such as the common hook, may be more suitable for some tools, such as a rotary electric drill, than for others, such as a common screwdriver. Any (1) hooks and/or (2) snaps are commonly metal, and robustly sized, and thus undesirably (i) add weight to the tool belt and/or tool, while being (ii) subject to corrosion, and (iii) conductive of electricity.

Moreover, the fact that a fireman's, or a rigger's, harness does not look much like a workman's tool belt (nor, for that matter, do the tool belts of all workmen much resemble each other) may be a consequence of the specialized function of each rig, or may be simply a function of such lack of a comprehensive solution as the present invention will be seen to offer.

Study of hundreds, or even thousands, of pictures of belts and harnesses for the releasible holding of things on the human body will reveal that a first difference between tool belts and harnesses is that things—tools—are brought to and taken from a tool belt by use of the arms or hands but that a harness may call for engaging an external object by moving the body to the object as opposed to moving the object to the body. It has heretofore been nonsense to talk about a workman lifting and moving a heavy object, such as a filled five gallon paint can, by act of maneuvering his body on which is present merely a tool belt. This has been the province of harnesses. The present invention will be seen to break down this distinction, and to teach a "tool belt" that, as worn upon the waist of a workman, may be maneuvered to lift a filled five gallon paint can or something similarly heavy.

A second difference between tool belts and harnesses—other than the manner in which each is most commonly worn upon the body, and even this distinction wanes when a tool belt supported by shoulder straps is considered—is that harnesses, commonly being more expensive, often incorporate very exotic, full custom, holding and releasing hardware. The harnesses worn by firemen which serve to carry any of lights, oxygen bottles, axes and pry bars, and by military personnel as variously support weapons, ammunition, explosives, and electronic/navigational gear are typical. The great variation in weight, size, shape and desired accessibility of all these various items has until now precluded thought that some sort of unified universal system might possibly satisfy such diverse requirements.

It will be seen to be the premise of the present invention that an improvement can be made in the (1) tool belt to (2) tool holder and/or tool interface, basically by (i) an innovative design (ii) making use of the same modern plastic materials that serve as two-part snap release belt buckles.

2.2 The Need for a Tool Belt

Consideration of the requirements of the drywalling task provides a useful example as to why a tool belt is needed. Namely, drywall installation and taping does not require particularly many tools, but this backbreaking work mandates use of a tool belt.

Tools required included a pencil to make marks with, a chalk line to snap long straight lines, a compass for drawing circles, an awl and a keyhole saw. A specialized tool called a "Rotozip" can be used also. A utility knife and tape measure are also useful.

Next a good quality screw gun that is made for drywall installation, usually with an rpm rating of 4000, is normally used. These guns are supplied with a cone shaped tip that is used to "set" the depth of the head of a drywall screw.

A drywall hammer, in case you prefer to use nails, is normally used; its ax-like head is good for cutting lath.

A "T-square" is used to cut the drywall straight. It can also be used as a measuring tool and to mark out square cuts such as receptacles and light switches.

A surform rasp to clean edges of straight cuts is required; it is considered a block plane for drywall.

These tools must all at various times be held in a good quality tool belt, preferably one still other, optional, tools and personal effects of the drywaller's choice may also be held.

2.3 Commercial Offerings—Diverse Tool Belts and Bags

Tool belts and kits come in greatly diverse variants. The JELCO Company at 3160 de Rouen, Montreal QC H1W 1K7, Canada [appearing on the internet circa 2002 at <http://www.jelco-alubox.com>] itself alone offers at least the following eighteen (18) products.

Offered is a lineman's kit bag, super heavy duty nylon, yellow latex coated, with black nylon 2" (50 mm) carrying straps, bottom reinforced with solid ¼" (6 mm) thick plastic plate, sewn with nylon thread, heavy duty aluminum zipper in two sizes (10×15×24 and 9×11×16).

Also offered is a canvas bag made of water repellant No. 10 Canvas duck, with two cotton webbing straps with snap and deep ring fastener to hook on to lineman's tool belt, a top opening reinforced with heavy rope, and a bottom reinforced with leather strip and water drain hole provided.

Also offered is a large nut and bolt bag made of yellow treated nylon duck with side pocket for safety glasses.

Also offered is a an extra large tool and bolt bag vinyl laminated nylon with rigid top opening, many side pockets and leather safety glasses holder.

Also offered is a large glove bag Flare top opening, velcro flap closure c/w safety glasses pouch, 18" long made of yellow nylon/vinyl material.

Also offered is a rubber glove bag made of strong canvas duck with web strap with snap hook and deep ring at back, flap closure with two press buttons. This bag is available in two sizes, 16" and 18" long.

Also offered is a tool holster made of selected harness leather with double thickness back panel stitched with waxed linen thread and three pockets rivetted on and fitted with a spring snap hook of cadmium plated steel. This holster is made to attach on any tool belt with a metal loop and clip.

Also offered is a piler and knife holster, heavy waterproof leather, two pockets sewn and rivetted adjustable belt loops and press buttons at back.

Also offered is a large five-pocket tool holster made of selected saddlery leather attaches to any linemen's belt by snap fastener loops.

Also offered with a tool holster made of selected harness leather with two formed pockets for large tools and a small rivetted pocket for scissors. Two wide loopholes are provided to thread this holster on any belt.

Also offered is a tool pocket made of soft lightweight but super strong moisture proof retan leather. Sewn with waxed linen thread, this pocket has a large number of inside loops for tools of all dimensions.

Also offered is a tool pouch with room for many tools, three flat pockets in front, two side loops for screwdrivers and a loop for flashlight. Made of top grain retan leather and all rivetted construction the pouch is advanced as suitable for indoor or outdoor use.

Also offered is a hand line carrier to take a hand line up a pole will open automatically under load should the line snag on something. This has a rawhide tongue with cadmium plated spring steel clip, and tongue latigo leather with fibre cross piece slotted to loop over belt or ring.

Also offered is a hand line hook of the plastic breakaway type suitably fitting over any linemen's belt.

Also offered is a single plier holster made from heavy gauge waterproof leather all rivetted with 2" (50 mm) slots to slide on any belt.

Also offered are support braces for linemen's belt. Made from one inch wide nylon strapping with leather shoulder pads and metal snap hooks, the braces are not suitable as a fall arrest harness.

Also offered are support braces for linemen's belt. Made from wide and stiff nylon web with a Velcro closure on the chest strap and plastic fittings, these support braces are fully adjustable fur again not suitable to serve as a fall arrest harness.

Also offered is a waist belt for carrying tool pouch, heavy 2" (50 mm) wide leather tongue type buckle adjustable to any size up to 48" (1.20 m). This is not a safety belt. It comes with 4 no. 7399 loops and snaps.

The point of the eighteen (18) products is not that each, or even any, can be the single closest prior art to the present invention, but simply that the diverse requirements of tool holders, belts and harnesses are immediately recognizable.

2.4 Tool Belts and Harnesses for Life Safety

Life Safety Consulting and Equipment, Inc. of 159 Duncan Trail Longwood, Fla. 32779 [appearing on the Internet circa 2002 ta <http://www.lifesafetyequip.com. sells a typical range of life safety equipments of the order of a-arm belts, rope and rope systems, carabineers and pulleys, ascenders and descenders, harnesses and personal equipment, anchorages and bags.

Grommet hangers with quick release permit a fire fighter to add a large grommet hanger along with a quick release snap to hold any heavy headed tool such as an ax, halligan or sledge. The fire fighter can add as many grommet hangers as wanted and put them at any location on the belt. The grommet hangers come in two sizes, small and large and can also be added to the belt to accommodate flashlights.

2.5 Commercial Offerings—A Telephone Repair Kit with Belt Clips

Telephone repairman tools normally include in two pouches that fit neatly on a tool belt a "butt-set" with ringer and polarity test 66 and 110 punch tool, screwdrivers, pliers, a wire cutter and stripper, scissors, a knife, and a flashlight. Cordura pouches are equipped with police style belt clips.

2.6 Commercial Offerings—A Tool with a Built-In Belt Clip

Makita brand drywall screw drivers, among other electrical power tools, incorporate an retractable belt clip for attaching to tool belt. This is in a typical tool of variable speed (0–4,500 RPM) for fast installation of drywall.

SUMMARY OF THE INVENTION

The present invention in general contemplates a belt-based tool-holding, tool-transporting and tool-storage system suitable for diverse types of hand tools both powered and manual.

Although commonly called a "tool belt", or a "tool holder system", the present invention is suitable to attach any of (i) tool or gear holders, clips, buttons, bags, containers and the like, and also both hand and powered tools themselves—each of which attached objects mounts a first-type, typically male, connector portion—to (ii) a belt or harness, most commonly located at a human waist—to which belt or harness is affixed, and selectively removably affixed including in selected locations, one or complimentary second-type, typically female, connector portions.

The first-type, male, connector portion preferably has and presents retaining tabs, or clips, which are held in spaced relationship under spring forces to retain the male connector portion at and to the female connector portion. These tabs or clips are both (i) compressible to slide the male connector portion into the female connector portion, and (ii) compressible under force of the fingers to release the male connector portion from the female connector portion. These (typically) male connector portions readily, and removably by use of screws and nut if desired, attach any of tool or gear holders, clips, buttons, bags, containers and the like, and also directly to both hand and powered tools. These male connector portions thus serve, in conjunction with the female connector portions affixed to the tool belt or harness, to suitably directly, or indirectly, removably connect almost anything of suitable size and weight to the belt or harness.

Meanwhile, the female connector portions are preferably pre-positioned upon, and along the length of, the belt or harness in the positions, and the numbers, and even as between "top-loading" and "bottom-loading" types as are desired by the owner/user of the tool belt, or harness.

Accordingly, the tool belt, or tool system, is both extremely versatile, and versatilely configurable and re-configurable, to hold items used in (i) the building trades including carpentry and electrical; (ii) recreation, including hiking, camping, hunting, fishing and mountain climbing; and (iii) the military.

1. The Preferred Tool Belt System of the Present Invention

In the preferred implementation of the present invention as a tool belt system, (1) diverse selectable tool holders are suitable to hold correspondingly diverse types of portable tools selectively removably mount upon a tool belt by and through a quick-connect, quick-disconnect connector, while, also (2) certain other tools selectively removably mount directly to the tool belt by use of the same connectors. The connectors are locatable in selected numbers, and in selected positions, along the tool belt. A first, typically female, portion of each connector is (i) permanently, such as by riveting, or (ii) semi-permanently, such as by nut and screw, attached to the belt at selected locations thereupon, which locations may selected among locations pre-specified by scoring, marking, hole-punching or otherwise pre-conditioning the belt. The connectors may in and all of types, numbers and locations be placed upon the tool belt by the manufacturer, or these connectors may be offered as piece parts for assembly upon the tool belt by a person purchasing the tool belt and desiring to fully customize it.

The two-portion connectors are preferably of two major types as permit that tool holders and/or tools should be mounted in and by either (1) an upward, or (2) a downward, motion (with a reverse motion in either case serving to dis-connect the connector, and to dis-mount the tool holder or tool).

The system is thus eminently flexible, versatile and tailerable to the requirements and desires of its owner/user. The owner/user of the system can detachably mount and carry almost any tool that he or she wants, by almost any holder of direct tool attachment that he or she desires, at almost any desired location along the tool belt, to any reasonable total number of tools. Instead of the owner/user conforming to a tool belt that is invariable in any or all of (i) the mechanism (s) for mounting each tool, or tool type, (ii) the locations at which tools and/or tool holder of a certain type are suitably mounted, and/or (iii) the total number of mounting points and mounted tools or tool holders, the owner/user can quite easily, flexibly, and inexpensively make the tool belt into anything he or she wants it to be, and to serve diverse purposes including as a carrier of items not commonly thought of as "tools".

2. The Preferred Function of the Tool Belt System of the Present Invention

In its preferred embodiment, the tool belt system of the present invention releasibly interchangeably mounts along the length of a tool belt both (1) tool holders of diverse types as themselves serve to releasibly hold tools, and/or (ii) tools. According to the numbers, types and order of tool holders and tools that are mounted, and the locations along the tool belt where these tool holders are so mounted, the tool belt system is quite easily, and readily, configurable by its user/owner to releasibly hold either directly or indirectly just about every kind of portable tool imaginable.

This releasible mounting of tool holders and/or tools to a tool belt preferably transpires by a sliding mechanical action (as opposed to, for example, a snapping, or a hooking, or a clamping action) between two parts of a connector. That is, the mounting of both tool holders and/or tools to the belt is preferably by a sliding action, and is more preferably by a connector tongue piece sliding within a connector groove piece, and is still more preferably by a connector tongue piece that is upon, and permanently or semi-permanently affixed to, either a tool holder or a tool sliding into a corresponding groove piece that is upon, and semi-permanently or permanently affixed to, the tool belt.

The present invention further still contemplates that a preferred two, slightly different, connectors each consisting of one tongue piece and one groove piece should have these two pieces coact such that a tool holder (or tool) may be mounted to (dismounted from) the tool belt in either (1) an upward, or (2) a downward, direction when the tool belt is worn at the waist of a workman.

The present invention still further contemplates that preferred "connector tongue pieces" and "connector groove pieces" of both types are subject to being positively locked in their sliding engagement, ensuring positive retention of tool holders and/or tools to the belt. This positive locking is preferably realized by a spring latch that is integral with the connector tongue piece (which piece, it may be recalled, is preferably mounted to the tool holder, or tool). The preferred spring latch may be actuated by the fingers to release a tool holder, or a tool, from the tool belt.

3. The Most Preferred Structure of the Tool Belt System of the Present Invention The "connector groove pieces" may alternatively be called "receiver blocks", and the "connector groove pieces" may alternatively be called "attaching blocks" because both pieces, in both varieties, are substantially rectilinear in form, resembling blocks.

In its most preferred embodiment, the present invention is realized in (1) a tool belt having (2) receiver blocks, preferably of at least two types, spaced and permanently mounted along its length, each receiver block being suitable to releasibly receive and engage (3) an attaching block of complimentary configuration, each which attaching blocks serves to attach (4a) one of any number of tool holders of diverse configurations, each of which tool holders serves to support an associated tool, and/or (4b) a tool itself.

The adjustable tool belt is preferably made from inexpensive, but strong and durable and comfortable, web material, with a strong snap-lock plastic buckle. The belt has a typically large number of typically plastic receiver blocks, which are most commonly of two principle types, mounted along its length. In some cases the owner/user may purchase, and may mount via rivets or screws, receiver blocks, which are preferably inch-size contoured pieces of strong but inexpensive plastic, in the locations, numbers and types of the owner/user's choice.

The owner/user also selects and purchases tool holders—modestly-sized items most typically made of metal and/or leather each with a typically plastic attaching block affixed—appropriate to the nature and numbers of portable tools that the owner/user from time to time wishes to carry on his or her tool belt. Tool holders (i) selectively mount to the tool belt, and (ii) hold tools, as will be explained. However, when a tool is withdrawn for use from its storage position on the tool belt, the tool holder remains with the belt, as is perhaps most common for tool belts, and as will also be explained.

Importantly, however, the owner/user may alternatively purchase attaching blocks—like as to those which are part of the tool holders—directly. These attaching blocks, like the receiver blocks to which they mate, are most commonly inch-size pieces of strong but inexpensive plastic. They permanently or semi-permanently mount directly to a portable tool, such as by use of rivets or screws. These receiver blocks are so small and light so as to typically be of no consequence to use of the tool which they serve to releasibly mount to the tool belt.

A user of the tool belt loads the tool belt with selected tools in selected order at selected intervals by the following process. The user selects and purchases a tool holder—modestly-sized items most typically made of metal and/or leather each with a typically plastic attaching block affixed—appropriate to each of whatsoever nature, and numbers, of portable tools that the user wishes to carry on his or her tool belt. Alternatively, the user may mount an attaching block directly to a tool). (ii) each with an attaching block affixed, and then (ii) affixing the attaching blocks each to a receiving block at selected locations, and in any desired order, along the tool belt. where it is desired to ultimately locate an associated tool.

4. A Tool Belt System Mounting Both Tools and Tool Holders in Numbers, Locations and Types Desired, and Receiving and Releasing Both Tool Holders and Tools Both Upward and Downward Therefore, in one of its aspects the present invention is embodied in a tool belt system having (i) an elongate tool belt, (ii) a multiplicity of connector first parts, called receiver blocks, spaced, and permanently mounted, along the length of the elongate tool belt, and (iii) a plurality of connector second parts, called attaching blocks, suitable to selectively removably mount to the receiver blocks. Each attaching block itself affixes either (i) a tool holder which in turn holds a tool, or (ii) a tool itself. Each connector first part, or receiver block, is suitably selectively receives and to removably engages a corresponding connector second part, or attaching block, which is of complimentary configuration.

By this construction, and this coaction, a user/wearer of the tool belt may select numbers, types and locations of both tool holders and/or tools along the tool belt by act of (i) selecting desired ones of the plurality of tool holders (each of which affixes an attaching block), and/or affixing an attaching block directly to a tool, and then (ii) attaching each tool holder, or tool, via its attaching block to a selected receiving block, mounted to the tool belt at a desired location along the tool belt.

Each of (i) the multiplicity of connector first parts, or receiving blocks, mounted to the tool belt, and (ii) the connector second parts, or attaching blocks, affixed to the tool holders or to the tools, are preferably related as interlocking tongue-and-groove structures. More particularly, each of multiplicity of connector first parts, or receiving blocks, mounted to the tool belt preferably includes a groove part defining a channel that is substantially vertical when the tool belt is worn upon a waist of an owner/user of the tool belt. Meanwhile, each of those connector second parts, or attaching blocks, which are affixed to either a tool holder, or directly to a tool, preferably includes a tongue part defining a tongue that fits within the channel of the groove part in an orientation so as to permit any associated tool holder to hold an associated tool substantially vertically, or to directly so hold the tool substantially vertically.

Notably, the receiving blocks and the attaching blocks are preferably of two different types, and the preferred "tongue and groove" interaction between them permits that a tool holder, or a tool can be, depending upon type, unloaded from the tool belt either by (i) pulling up (as with the handle of the tool) (which pulling up may optionally be conditioned upon a snap release so as to prevent a tool holder, or tool, from popping out), or (ii) releasing with the finger tips a snap-locked attaching block from its receiving block, permitting the attaching block and anything affixed thereto (namely, a tool holder and/or a tool) to "fall away" under force of gravity.

The capability of the tool belt system of the present invention to both receive and release both tool holders and tools both upward and downward directions certainly serves to satisfy the preferences of the use owner/user for the attachment of tools, and each tool, to his or her tool belt, but the primary reason for this construction may not be immediately understood. The ability to extract tools by pulling up (attach a tool by pushing down), as in the action of removing a hand gun from a holster (holstering a hand gun), besuits normal usage of normal hand held tools, including electric drills and the like. However, the ability to attach a load—a tool or whatever—from the bottom of the belt, and to later release it downward, permits very heavy loads to be lifted and transported by proper use of the strong muscles of the legs, and not the back or arms. Consider, for example, a long walk with a filled five gallon paint can. A tool holder—attachable upward onto to the tool belt—in the form of a hook, or snap-lock hook, may be positioned to the fore of the belt. The owner/user/wearer of the "tool" belt can squat, hook the handle of, and raise the paint can purely by motion of the legs. Of course, so far the operation of this tool holder in the form of a hook to attach to the tool belt in an upward (as opposed to a downward) motion has not been invoked. But consider release of the paint can onto, for example, a table. The owner/user/wearer of the tool belt can simply snap loose the tool holder, extricating himself or herself from the load. That part of the tool holder still attached to the paint can, or whatever, can then be retrieved.

5. A Tool Belt System with Snap-Lock Mounting of Tool Holders and/or Tools

In another of its aspects the present invention is embodied in a tool belt system with snap-lock mounting of tool holders and/or tools.

In the tool belt system a number of snap-lock connector first parts permanently are located and affixed along an elongate tool belt. These first parts are generally lightweight, and of unsuitable contour to attach any tool directly and without more.

Instead, these first parts act through, and with, a number of snap-lock connector second parts as do each permanently affix and attach either (i) a tool holder or (ii) a tool. The first and second parts so cooperatively act so that—when each selected one of the snap-lock connector second parts is positioned at a location along the tool belt where desired—the second part may be removably snap-locked to a selected associated one of the snap-lock connector first parts. By this coaction a tool holder or a tool becomes located and removably locked to the tool belt at a desired location.

Clearly substitution of any of the types, locations, and numbers of tools and/or tool holders removably locked to the tool belt is a simple matter of un-snap-locking and removing and/or moving selected tools and/or tool holders, and snap-locking substitute tools and tool holders at desired positions along the elongate tool belt.

In this tool belt system the snap-lock connector first parts preferably consist of a first-part connector member, called a "receiving block", defining a channel. Meanwhile, the snap-lock connector second parts, called an "attaching block", consist of (i) a second-part connector member defining a tongue complimentary to the first-part connector member's channel for sliding within the channel of the first-part connector member, plus (ii) a snap lock for extending under spring force to lock the second-part connector member to the first-part connector member when the tongue of the second-part connector member is slid sufficiently far within the channel of the first-part connector member.

The first-part art connector member, the second-part connector member, and the snap lock preferably all consist of plastic. Indeed, the second-part connector member and the snap lock of the connector second part (the attaching block) are is preferably integral in one piece.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow.

DESCRIPTION OF THE PREFERRED EMBODIMENT

The following description is of the best mode presently contemplated for the carrying out of the invention. This description is made for the purpose of illustrating the general principles of the invention, and is not to be taken in a limiting sense. The scope of the invention is best determined by reference to the appended claims.

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

Figure 1:
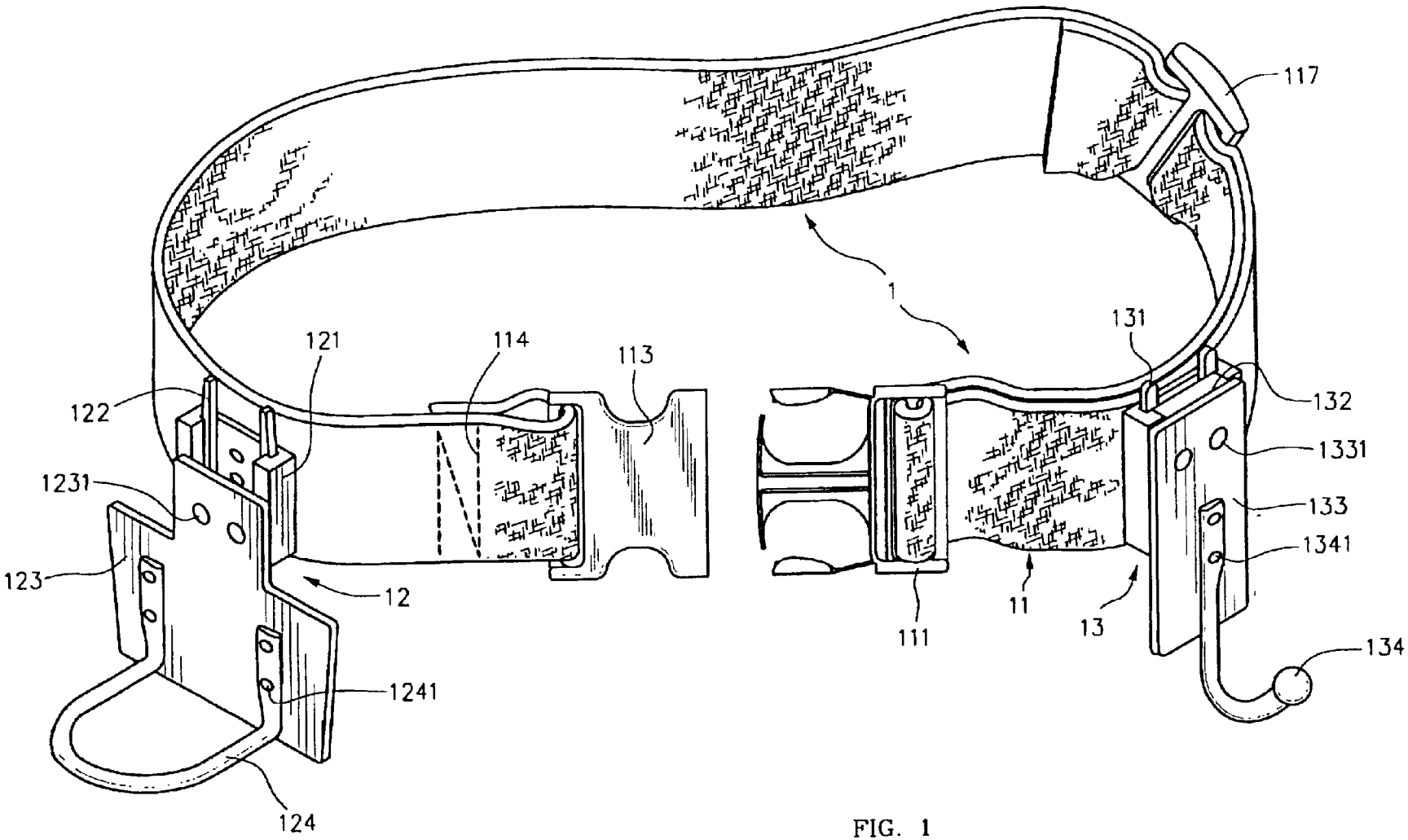
FIG. 1 is a diagrammatic perspective view showing a preferred embodiment of a tool belt system in accordance with the present invention.

A diagrammatic perspective view showing a preferred embodiment of a tool belt system 1 in accordance with the present invention is shown in FIG. 1. The system 1 is preferably based on a belt 11, which is preferably made of fabric web material. The belt 1 is adjustable in length through buckle first part 111, with the excess length retained by sliding clasp 112. A buckle second part 112 is preferably sewn to the belt by stitching 114. The buckle first part 111 and the buckle second part 112 are preferably made of strong plastic, and releasibly snap lock to each other.

Tool holders and/or tools detachably mount along the length of belt 11 wherever exist receiver blocks, of which two only such—both of the tool holder type—are shown in FIG. 1 for the sake of simplicity.

A first, and a first-type, tool holder 12 includes a first-type receiver block 121 and a first-type attaching block 122 (further seen in detail in FIGS. 2–4), and also a planar body, or placard, 123 and a loop 124 for holding a tool (not shown) such as a claw hammer. The first tool holder 12 loads from the bottom; meaning that first-type attaching block 122 is slid (in part) upward into first-type receiver block 121 in accordance with the present invention. The planar body, or placard, 123 attaches permanently to first-type receiver block 121 by screws and nuts or, preferably, rivets 1231. The loop 124 likewise attaches permanently to the planar body, or placard, 124 by screws and nuts or, preferably, rivets 1241.

Both the first-type receiver block 121 and the first-type attaching block 122 (as will be further seen in detail in FIGS. 2–4) are preferably made of strong plastic or metal, preferably acetal plastic as is available under the brand name Delrin™ from the DuPont Corporation, Delaware, USA (Delrin is a trademark of E.I. DuPont de Nemours and Company). The planar body, or placard, 123 is typically tanned leather, and the loop 124 is typically chromed steel.

Meanwhile, a second, and a second-type, tool holder 13 includes a second-type receiver block 131 and a second-type attaching block 132 (further seen in detail in FIGS. 6–9), and also a planar body, or placard, 133 and a hook 134 for holding a tool (not shown) such as a trowel with an aperture in its handle. The second tool holder 13 loads from the bottom; meaning that second-type attaching block 132 is slid (in part) downward into first-type receiver block 131 in accordance with the present invention. The planar body, or placard, 133 attaches permanently to the second-type receiver block 132 by screws and nuts or, preferably, rivets 1331. The hook 134 likewise attaches permanently to the planar body, or placard, 133 by screws and nuts or, preferably, rivets 1341.

Like the first tool holder 12, both the second-type receiver block 131 and the second-type attaching block 132 (as will be further seen in detail in FIGS. 6–9) are again preferably made of metal or strong plastic such as Dieldrin. The planar body, or placard, 133 may again be tanned leather but is more preferably metal or plastic. The hook 124 is typically chromed steel.

It will be understood that many first-type receiver blocks 121, and second-type receiver blocks 131 may be mounted in any order, most preferably by rivets and washers as necessary (not shown) along the length of belt 11, It is even possible for a purchaser/owner/user to mount his or her own receiving blocks in numbers and locations as are desired. Any receiving blocks 121, 131 that are not used are no great loss: they are inexpensive, and add but little weight.

Likewise, and although only one type of tool holder has been shown for each of the first-type attaching block 122 and a second-type attaching block 132—as respectively removably attach to the first-type receiver blocks 121 and to second-type receiver blocks 131—many different types of tool holders may be realized for each of the "bottom-loading" attaching blocks 122 and the "top-loading" attaching blocks 132.

Still further, the attachment of a first-type attaching block 122 or second-type attaching block 132 directly to a tool (not shown) has not been shown. Since, as will become increasingly clear upon reference to the detail views, these attaching blocks 122, 132 are really but small pieces of contoured plastic with holes that permit the use of fasteners to affix, in the instances of FIG. 1, the placards 123 and 133. However, a practitioner of the fastener arts will immediately recognize that these attaching blocks 122, 132 could be affixed to anything from, for example, a relatively large electric drill to, for example, the side of either the handle or shaft of a relatively small awl. The parts of the preferred embodiment of a tool holder in accordance with the present invention readily support the creation of a "full custom" system, and use of these parts in applications such as hunting, fishing, and military operations is contemplated.

Figure 2:
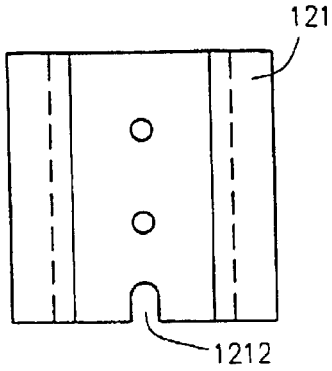
FIG. 2 is a front plan view.
Figure 3:
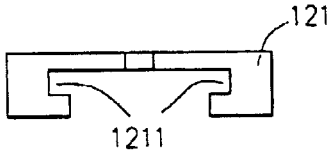
FIG. 3 is a bottom plan view of a preferred first embodiment of a receiver block that is used in, and part of, the tool belt system in accordance with the present invention previously seen in FIG. 1.
Figure 4:
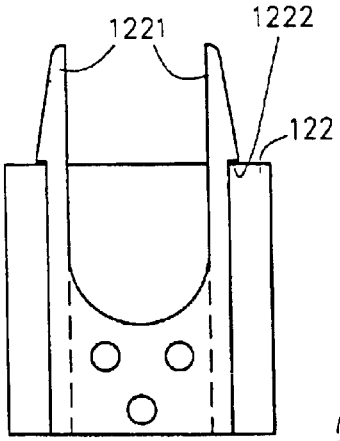
FIG. 4 is a front plan view.
Figure 5:
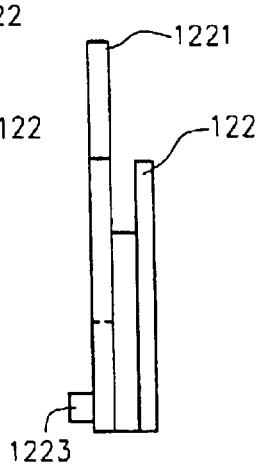
FIG. 5 is a side plan view, of a preferred first embodiment of an attaching block, suitably removably mounted to the first embodiment receiver block shown in FIGS. 2 and 3, that is used in, and part of, the tool belt system in accordance with the present invention previously seen in FIG. 1.

Detail views of the preferred embodiments of the first-type receiver block 121, and of the first-type attaching block 122—both previously seen in FIG. 1—are respectively shown in (i) FIGS. 2 and 3, and (ii) FIGS. 4 and 5. The first-type receiver block 121 defines a channel 1211 (best seen in FIG. 3) in which is received the bendable and displaceable "forks" 1221 (best seen in FIG. 4) of the first-type attaching block 122. These "forks" 1221 bend inward under ramp force during upward sliding insertion of first-type attaching block 122 into the channel 1211 of first-type receiver block 121. When insertion is full, a lip edge 1222 on each of the forks 1221 grabs the top of the channel 1211 as shown in FIG. 1, retaining the first-type attaching block 122 within the first-type receiver block 121. A pin 1223 on the first-type attaching block 122 cooperatively interacts with a notch 1212 on the first-type receiver block 121 to help hold alignment, and also to stop further travel of the attaching block.

When the first-type attaching block 122 is to be extracted downward from the first-type receiver block 121—i.e., oppositely to the way that it went in—then the owner/user/wearer of the tool belt system 1 simply squeezed together with his/her fingers the upper tips of the forks 1221, permitting the first-type attaching block 122 to descend downward through the channel 1212 of the first-type receiver block 121, and to fall away, under force of gravity.

Figure 6:
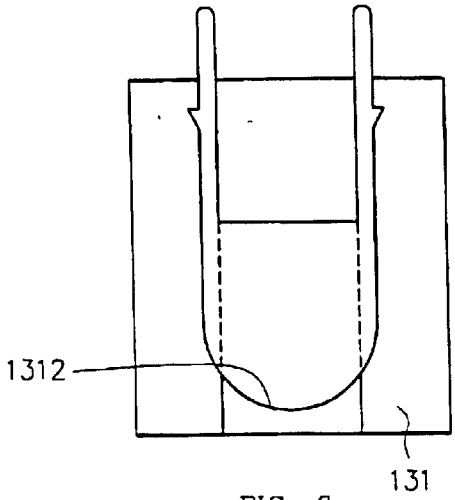
FIG. 6 is a front plan view.
Figure 8:
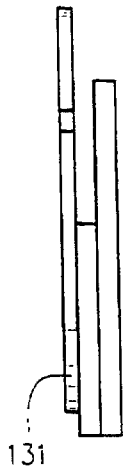
FIG. 8 is a side plan view of a preferred second embodiment of a receiver block used in, and part of, the tool belt system in accordance with the present invention previously seen in FIG. 1.
Figure 7:
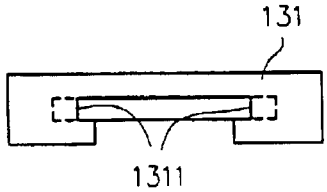
FIG. 7 is a top plan view.
Figure 9:
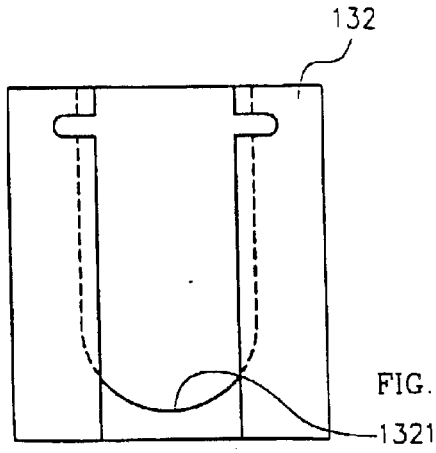
FIG. 9 is a front plan view of a preferred second embodiment of an attaching block, suitably removably mounted to the second embodiment receiver block shown in FIGS. 6 through 8, used in, and part of, the tool belt system in accordance with the present invention previously seen in FIG. 1.

Detail views of the preferred embodiments of the second-type receiver block 131, and of the second-type attaching block 132—both previously seen in FIG. 1—are respectively shown in (i) FIGS. 6 through 8, and (ii) FIG. 9. The first-type receiver block 131 defines a closed end channel 1311 (best seen in FIG. 7) in which is received the complimentary "tongue" 1321 (best seen in FIG. 9) of the second-type attaching block 132. This "tongue" 1321 proceeds downward into the channel 1311 of the second-type receiver block 131 until stopped by unrelieved portion 1312. When insertion is full the second-type attaching block 132 is strongly and stably held within the second-type receiver block 131.

When the second-type attaching block 132 is to be extracted upward from the second-type receiver block 131—i.e., oppositely to the direction in which it went in—then the owner/user/wearer of the tool belt system 1 simply grabs the tool holder parts 133, 134 (shown in FIG. 1) and/or, and of necessity when the second-type receiver block 131, squeezes the upward extension of the lifting block 132, and lifts. As soon as the tongue 1321 of the second-type attaching block 132 is lifted out of the channel 1311 of the second-type receiver block 131, the tool holder and any tool held thereby (or affixed thereto) is freed.

These processes all go much faster than they can be explained in words, and a practitioner of the mechanical arts will understand that the receiver blocks 121, 131 and attaching blocks 122, 132—of both types—in accordance with the present invention generally permit of moving tool holders and/or tools of diverse types around, and to and from (onto and off from) a tool belt 11, with great rapidity. Moreover, the tool belt, or "system" 1 itself is readily configurable and re-configurable by its owner/user. It is, for example, possible for an owner/user with a very particular carry and/or attachment requirement to fabricate some fastening, and/or releasible fastening, mechanisms himself/herself, using primarily only the belt 11 and blocks 12, 13 of the present invention.

Figure 10:
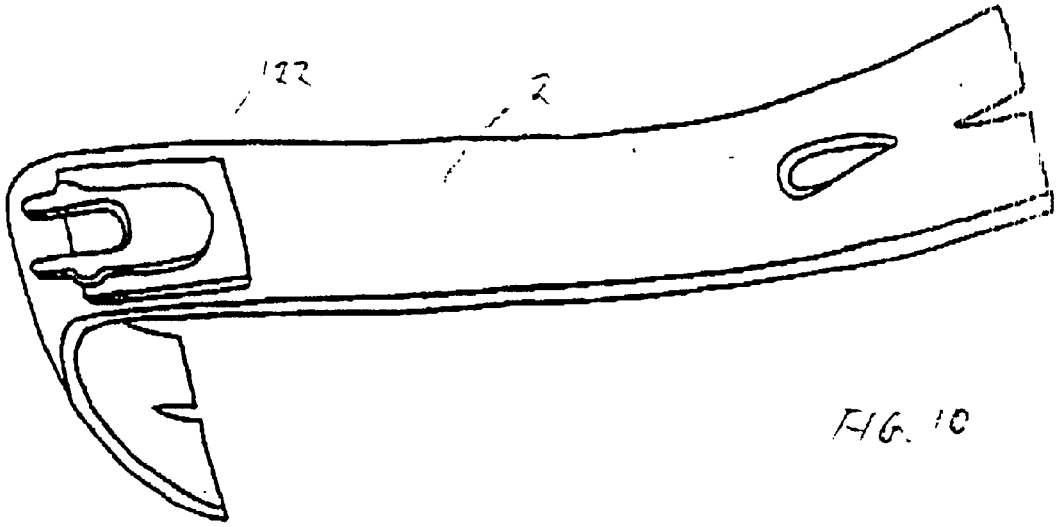
FIG. 10 is a perspective view of a tool affixing the attaching block previously seen in FIGS. 4 and 5.
Figure 11:
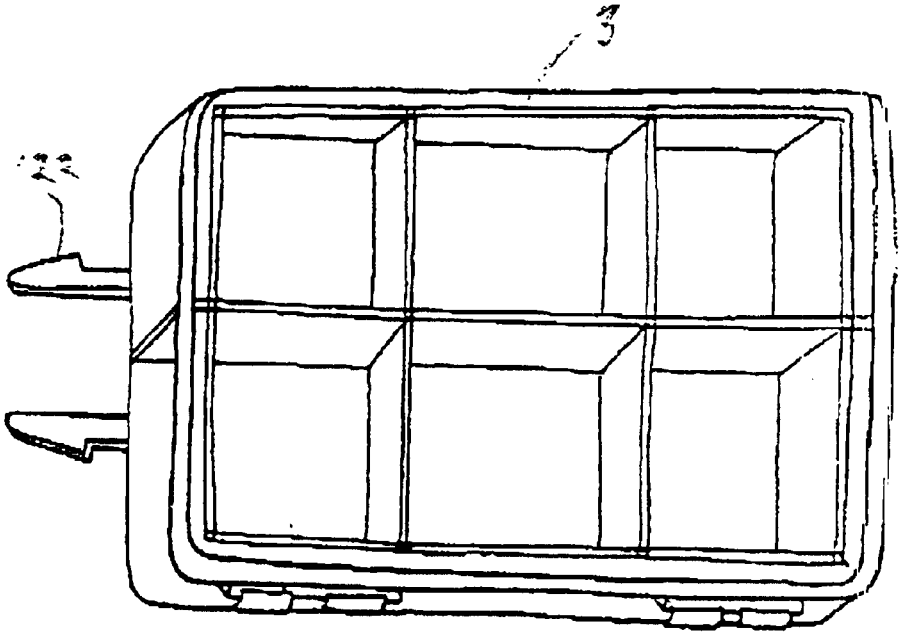
FIG. 11 is a perspective view of a container affixing the attaching block previously seen in FIGS. 4 and 5.
Figure 12:
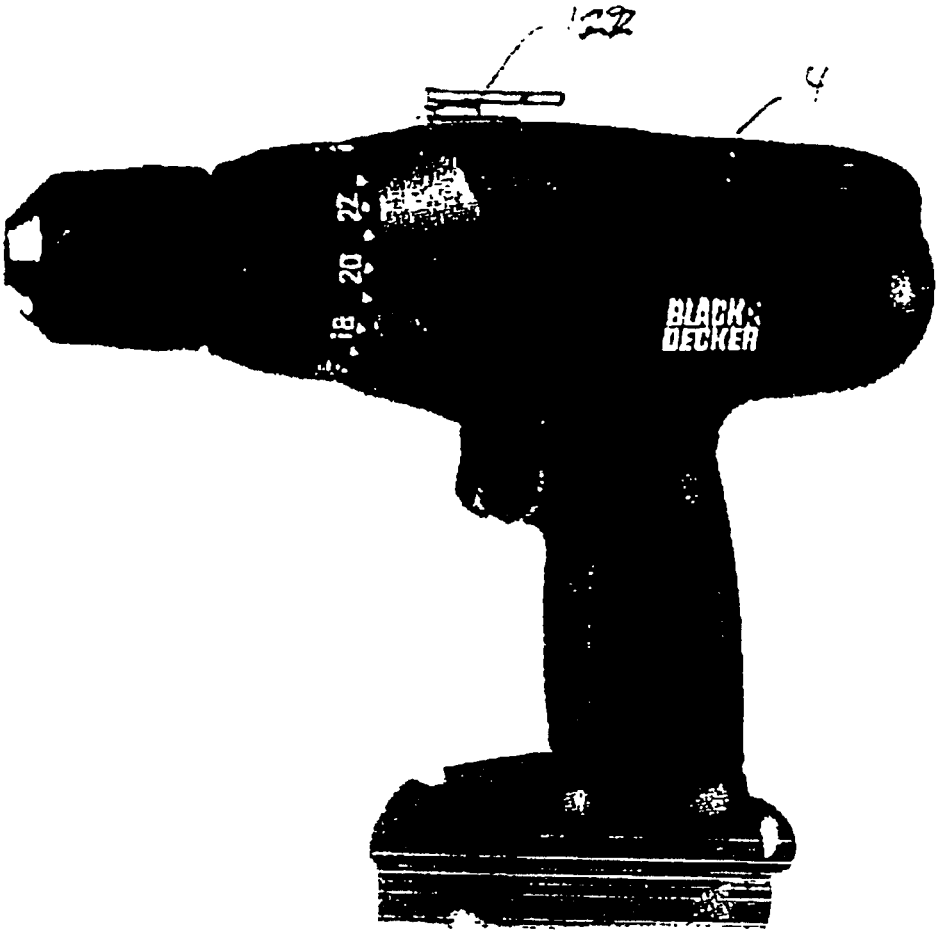
FIG. 12 is a perspective view of a power tool affixing the attaching block previously seen in FIGS. 4 and 5.

A perspective view of a tool 2, to wit: a pry bar, affixing the attaching block 122 previously seen in FIGS. 4 and 5 is shown in FIG. 10. A perspective view of a container 3 box affixing the same attaching block 122 is shown in FIG. 11. The container 3 shown is a small lidded box, most typically made of plastic, suitable to hold, by way of example, nuts and screws and other fasteners, or fishing hooks and lures. Finally a substantial power tool, namely an electric hand drill 4, yet again affixing the same attaching block 122 is shown in FIG. 12. In accordance with the present invention, all these hand tools 2, and containers 3, and power tools 4—as well as many other things—may have attaching blocks 122 or equivalent affixed by adhesive, riveting, screws and nuts or the like to later become supported on the tool belt 11 shown in FIG. 1 by action of the "snap-lock" connection of these attaching blocks 122 (or equivalents) to the receiving blocks 121 (or equivalent).

In accordance with the preceding explanation, variations and adaptations of the tool holder system in accordance with the present invention will suggest themselves to a practitioner of the mechanical arts.

For example, the belt 11 could be contoured like as that of an athletic weight lifter, and equipped with robust releasible blocks in accordance with the present invention for very heavy lifting and/or pulling.

In accordance with these and other possible variations and adaptations of the present invention, the scope of the invention should be determined in accordance with the following claims, only, and not solely in accordance with that embodiment within which the invention has been taught.

What is claimed is:

1. An tool belt system comprising:

an elongate tool belt;

a multiplicity of connector first parts spaced, and permanently mounted, along the length of the elongate tool belt, each connector first part being suitable to receive and to removably engage a connector second part of complimentary configuration, each connector first part having a substantially vertical channel when the elongate tool belt is worn substantially horizontal; and a plurality of different tool holders each permanently affixed to a connector second part, each connector second part having a tongue part sliding within the channel which tongue part has an integral spring clip feature that, when the tongue part is slid upwards within the channel sufficiently far, extends so as to lock the connector second part to the connector first part;

wherein a user/wearer of the tool belt may select numbers, types and locations of tool holders along the tool belt by act of selecting desired ones of the plurality of tool holders and attaching each via its affixed connector second part to a selected connector second part, mounted to the tool belt, at a desired location along the tool belt; and wherein the tongue part of the connector second fits within the channel of the connector first part in an orientation so as to permit the tool holder affixed to the connector second part to hold an associated tool by force of gravity when the tool belt is horizontal, and later, by manual release of the integral spring clip feature, permit the tool holder and the associated tool to exit downwards from the connector first part and to become released downwards from the tool belt.

2. The tool belt system according to claim 1 further comprising:

at least one connector first part directly affixed to a tool, with no intervening tool holder;

wherein the at least one connector first part can removably engage a connector first part upon the tool belt, holding the tool to the tool belt;

wherein the tool is picked up by the tool belt from a position atop the tool, and the tool is subsequently released downwards from the tool belt.

3. The tool belt system according to claim 1 wherein the integral spring clip feature of the connector second part slides upwards into the groove of the at least one connector first part until, sufficient insertion having transpired, it extends under spring force, engaging the tool holder to the tool belt where, at a later time, it may be released under force of the fingers, loosing the connector second pant and the integral tool holder from the connector first part.

4. The tool belt system according to claim 1 wherein the integral spring clip feature of the at least one connector second part can be squeezed by the fingers against the spring force to permit the tongue of the connector second part to slide downward in the channel of the connector first part, disengaging the connector second part from the connector first part and thus disengaging the tool holder from the tool belt.

5. A tool belt system having:

an elongate tool belt;

a multiplicity of snap-lock connector first part permanently located and affixed along the elongate tool belt, the first parts being generally lightweight and unsuitable to attach any tool or tool holder directly, each first part defining a channel; the first parts acting through a selected plurality of snap-lock connector second parts as do each permanently affix and attach either a tool holder or a tool, each second-part connector member both (1) defining a tongue complimentary to the first-part connector member's channel for sliding within the channel of the first-part connector member, and (2) having a snap lock for extending under spring force to lock the second-part connector member to the first-part connector member when the tongue of the second-part connector member is slid upwards sufficiently far within the channel of the first-part connector member;

in order to, when each selected one of the plurality of snap-lock connector second parts is, at a location along the tool belt where desired, removably snap-locked to a selected associated one of the multiplicity of snap-lock connector first parts, then a tool holder or a tool becomes located and removably locked to the tool belt at a desired location;

wherein substitution of any of the types, locations, and numbers of tools and tool holders removably locked to the tool belt is a simple matter of un-snap-locking and removing and/or moving selected tools and tool holders, and snap-locking substitute tools and tool holders at desired positions along the elongate tool belt;

wherein a second-part connector member permanently affixing and attaching either a tool holder or a tool is slid upwards within the channel of the first-part connector member until the second-part connector member becomes removably snap-locked to the first-part connector member, and thereafter manual release of the snap lock against the spring force is necessary to permit the second-part connector member and its affixed and attached tool holder or tool to slide downwards in and from the channel of the first-part connector member, and to detach from the elongate tool belt;

wherein the tool holders and tools with their attached and affixed second-part connector members both connect to, and disconnect from, the first-part connector members, and the tool belt, from the underside of the tool belt.

6. The tool belt system according to claim 5 wherein the first-art connector member comprises:

plastic;

and wherein the second-part connector member comprises:

plastic.

7. The tool belt system according to claim 6 wherein the snap lock comprises:

plastic.

8. The tool belt system according to claim 7 wherein the plastic second part connector member is integral in one piece with the plastic snap lock.

* * * * *